US005531417A

United States Patent [19]

Valiulis et al.

[11] Patent Number: 5,531,417

[45] Date of Patent: Jul. 2, 1996

[54] LOOP HOOK WITH LABEL HOLDER

[75] Inventors: Stanley J. Valiulis; Stanley C. Valiulis, both of Rockford, Ill.

[73] Assignee: Southern Imperial, Inc., Rockford, Ill.

[21] Appl. No.: 559,410

[22] Filed: Nov. 15, 1995

Related U.S. Application Data

[63] Continuation of Ser. No. 123,211, Sep. 20, 1993, abandoned.

[51] Int. Cl.[6] ..... B42F 13/00

[52] U.S. Cl. ..... 248/303; 211/57.1; 211/59.1; 211/106; 248/309.2

[58] Field of Search ..... 211/54.1, 57.1, 211/59.1, 106; 248/302, 303, 309.2; 40/642

[56] References Cited

U.S. PATENT DOCUMENTS

| | | | |
|---|---|---|---|
| 4,027,799 | 6/1977 | Stucker | 211/59.1 X |
| 4,104,817 | 8/1978 | Herzog | 211/59.1 X |
| 4,502,602 | 3/1985 | Swanson | 211/57.1 X |
| 5,014,949 | 5/1991 | Niven | 211/57.1 X |
| 5,042,699 | 8/1991 | Goldring | 211/57.1 X |
| 5,054,220 | 10/1991 | Touzalin | 40/642 |
| 5,088,606 | 2/1992 | Boas | 211/57.1 |
| 5,305,898 | 4/1994 | Merl | 211/106 X |
| 5,348,167 | 9/1994 | Jensen | 211/57.1 |

FOREIGN PATENT DOCUMENTS

| | | | |
|---|---|---|---|
| 2585549 | 2/1987 | France | 40/642 |

OTHER PUBLICATIONS

Sample of one–piece plastic loop bearing the legend "Made In Australia".

*Primary Examiner*—Ramon O. Ramirez
*Assistant Examiner*—Derek J. Berger
*Attorney, Agent, or Firm*—Leydig, Voit & Mayer, Ltd.

[57] ABSTRACT

A wire loop hook for displaying merchandise includes a rounded nose which supports a label holder in a downwardly and forwardly inclined position such that the top surface of the holder faces upwardly and forwardly and serves as a mounting surface for a merchandise identification label. In one embodiment, the nose of the loop hook itself is inclined downwardly and forwardly so as to enable use of a label holder of extremely simple construction. In another version, the loop hook is of conventional design with a generally horizontally extending nose while the label holder includes angled mounting and label holding portions to enable the holder to be attached to the generally horizontal nose with the label holding portion inclined downwardly and forwardly from the nose.

2 Claims, 3 Drawing Sheets

LOOP HOOK WITH LABEL HOLDER

This is a continuation of application Ser. No. 08/123,211, filed on Sep. 20, 1993 now abandoned.

BACKGROUND OF THE INVENTION

This invention relates generally to a display hanger or hook which is adapted to be attached to a perforated panel such as a "Pegboard" and which serves to hold and display retail merchandise.

More particularly, the invention relates to a so-called loop hook of the same general type as disclosed in Valiulis U.S. Pat. No. 5,236,163. A loop hook comprises a pair of laterally spaced and generally horizontally extending arms whose forward end portions are integrally joined by a substantially U-shaped nose. In the present loop hook, the arms and the nose are made from a single piece of wire.

Even more specifically, the invention relates to a wire loop hook having means for holding a tag or label printed with indicia (e.g., price, stock number, UPC code and the like) relating to the merchandise displayed on the hook. In the hook of the aforementioned Valiulis patent, the label is supported by a holder on the forward end of a so-called scanner arm comprising an elongated piece of wire joined to the hook and located above the merchandise-supporting arms thereof. Another type of scanner arm for a wire loop hook is disclosed in Valiulis U.S. Pat. No. 4,976,058 and comprises a plastic arm which also extends above the arms of the hook. The label is supported on a plate at the front of the scanner arm.

Loop hooks with scanner arms are disadvantageous in that the scanner arm adds significantly to the cost of the overall merchandise display package, the scanner arm occupies space above the hook and thus reduces the space available for the actual display of merchandise and, in some instances, the label holder or plate at the front of the scanner arm can make it difficult to place merchandise on and to remove merchandise from the loop hook.

SUMMARY OF THE INVENTION

The general aim of the present invention is to provide a wire loop hook having a new and improved label holder which is relatively simple and inexpensive, which occupies either little or no space above the hook, and which enables merchandise to be easily slid onto and off of the hook with virtually no interference from the label holder.

A more detailed object of the invention is to achieve the foregoing by providing a label holder which advantageously may be attached to the wire nose of the hook and which is oriented so as to support a label in an upwardly and forwardly facing direction while enabling merchandise to be easily slid forwardly and downwardly off of the hook.

Another object of the invention is to provide a wire loop hook having a nose which is uniquely inclined relative to the arms of the hook in order to automatically establish the desired orientation of the label holder and thereby simplify the construction of the holder.

Still another object is to provide a label holder for use with conventional loop hooks having a nose disposed in substantially the same plane as the arms of the hook, the label holder being uniquely shaped to cause the label to face upwardly and forwardly.

The invention also resides in the provision of relatively simple and inexpensive means for securing the label holder to the nose of the loop hook.

These and other objects and advantages of the invention will become more apparent from the following detailed description when taken in conjunction with the accompanying drawings.

Figure 1:
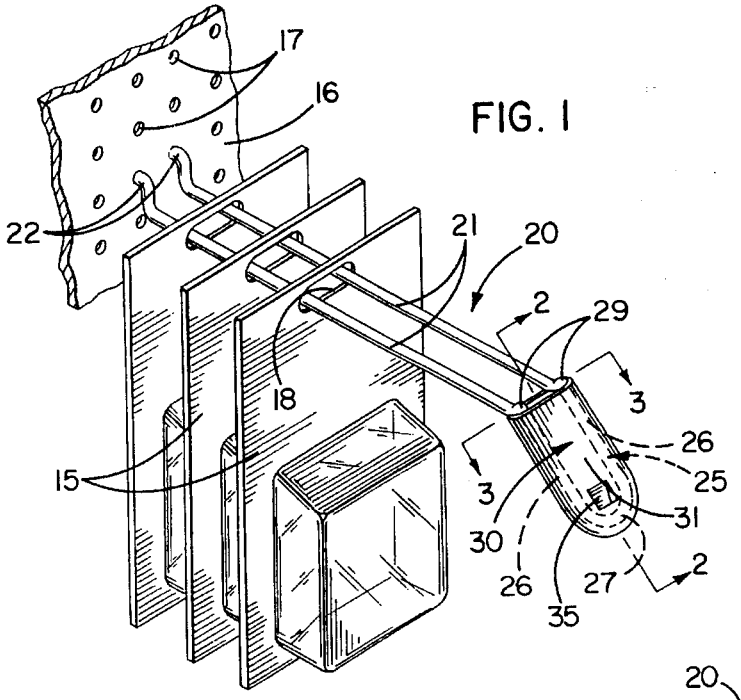
FIG. 1 is a perspective view showing one version of a new and improved loop hook attached to a typical perforated panel and equipped with one embodiment of a label holder incorporating the unique features of the present invention.

While the invention is susceptible of various modifications and alternative constructions, certain illustrated embodiments hereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention.

DETAILED DESCRIPTION OF THE PREFERRED EMBODIMENTS

For purposes of illustration, the invention has been shown in the drawings in conjunction with hangers or "hooks" for supporting and displaying articles 15 from a perforated panel or "Pegboard" 16 of the type formed with a series of vertically spaced and horizontally extending rows of holes 17. By way of example, the articles 15 may be merchandise packages whose upper end portions are formed with laterally elongated and horizontally extending slots 18 enabling the packages to be mounted on a hook.

The hook 20 which has been shown in FIG. 1 is a so-called loop hook which is made from a single piece of round wire. The hook includes two laterally spaced and generally horizontally extending arms 21 whose rear ends are formed with integral horns 22 adapted to be inserted through adjacent horizontal holes 17 in the panel 16 in order to attach the hook releasably to the panel. Formed integrally with the forward end portions of the arms is a generally U-shaped nose 25. The nose comprises two straight wire portions 26 joined to the arms and interconnected by an arcuate bridge portion 27. The packages 15 are adapted to be placed on the hook 20 by aligning the slots 18 with the nose 25 and by pushing the packages rearwardly along the nose and the arms 21.

Figure 2:
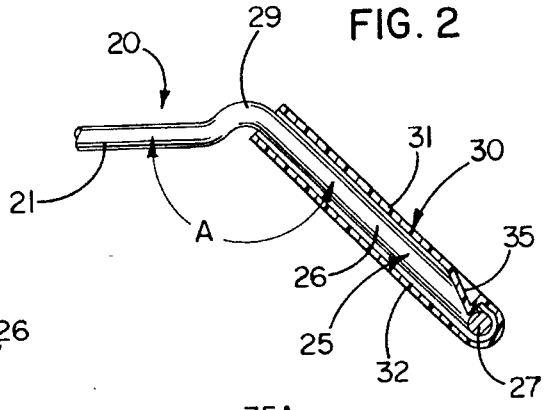
FIG. 2 is an enlarged fragmentary cross-section taken substantially along the line 2—2 of FIG. 1.
Figure 3:
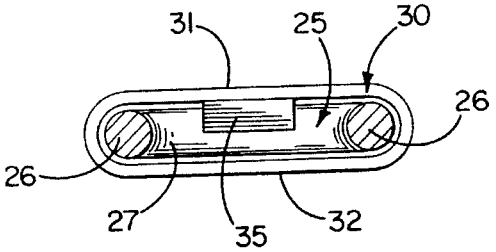
FIG. 3 is an enlarged cross-section taken substantially along the line 3—3 of FIG. 1.

In accordance with one aspect of the invention—and for a purpose which will become apparent subsequently—the nose 25 of the hook 20 is inclined downwardly and forwardly relative to the arms 21 at an obtuse included angle A (FIG. 2) of, for example, 140 degrees. Thus, packages 15 are removed from the hook by sliding the packages forwardly along the arms 21 and then by sliding the packages downwardly and forwardly off of the nose 25. The forward ends of the arms are formed with short upwardly and forwardly inclined wire transition sections 29 adjacent the nose in order to reduce the tendency of articles to drop off of the hook.

Pursuant to the invention, the wire nose 25 supports a holder 30 which, in turn, serves as a mounting for a label (not shown) such as a label having pressure-sensitive adhesive on one side and having an opposite side with printed indicia (e.g., price, stock number and other information) relating to the merchandise in the packages 15. The label holder 30 is characterized in that it is of relatively simple and inexpensive construction, it occupies virtually no space above the arms 21, and it does not substantially interfere with the placing of packages on or the removal of packages from the hook 20.

The label holder 30 shown in FIGS. 1–4 is generally in the form of a flat sleeve having substantially the same shape as the nose 25 of the hook 20. The sleeve 30 preferably is molded of plastic and is formed with an open rear end and a closed forward end. In the embodiment of FIGS. 1–4, the sleeve extends completely around the top, sides and bottom of the nose 25 and is formed with flat upper and lower surfaces 31 and 32, respectively. By virtue of the downward and forward inclination of the nose, the upper surface 31 faces upwardly and forwardly and defines a surface to which the label may be secured. The upwardly and forwardly facing label may be conveniently viewed by customers and also may be easily scanned by an electronic inventory wand.

The plastic sleeve 30 may be sized to telescope over the nose 25 with a snug fit and, to help hold the sleeve on the nose, a detent 35 is molded in the upper side of the sleeve. Herein, the detent is a generally V-shaped dimple which cams past the forward side of the bridge 27 of the nose as the sleeve is telescoped onto the nose. Upon clearing the bridge, the detent flexes downwardly and engages the rear side of the bridge to releasably retain the sleeve on the nose.

It will be noted that the sleeve 30 lies in substantially the same plane as the nose 25 and occupies virtually no space above the arms 21 of the hook 20. As a result, the sleeve does not interfere with overlying packages and enables a hook with such packages to be placed closely adjacent the hook 20. Also, the sleeve does not significantly interfere with the placing of packages 15 on or the removal of packages from the hook since the sleeve has generally the same profile as the nose and only nominally increases the dimensions of the hook adjacent the nose.

Figure 5:
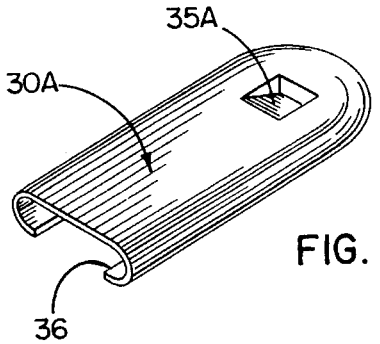
FIGS. 5–8 are views similar to FIG. 4 but show four additional versions of a label holder adapted for use with the hook of FIG. 1.
Figure 4:
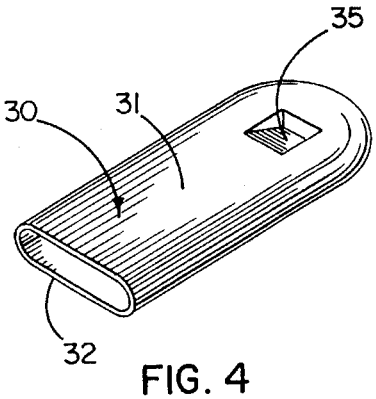
FIG. 4 is a perspective view of the label holder shown in FIG. 1.

In the embodiment of FIG. 5, the label holder 30A is a sleeve similar to the sleeve 30 but without a complete bottom surface. Thus the bottom of the sleeve 30A is defined by a slot 36 which extends from the open end of the sleeve to a point near the detent 35A so as to result in a saving of plastic.

Figure 6:
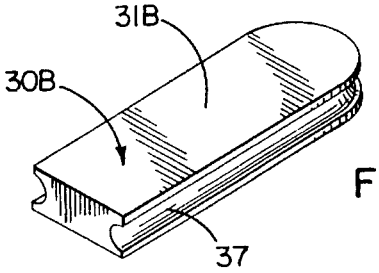

Another embodiment of a label holder 30B for use with the hook 20 is shown in FIG. 6 and, in this instance, the holder is in the form of a plastic insert which is adapted to be slipped into and telescoped within the nose 25. The insert 30B is a solid plastic block having the same configuration as the nose and having a periphery which is grooved as indicated at 37 in order to receive the straight wire portions 26 and the curved bridge portion 27 of the nose and thereby retain the insert in the nose after the insert has been slipped into the nose from the rear end thereof. The upper surface 31B of the insert faces upwardly and forwardly when the insert is installed in the nose and thus defines an appropriately oriented surface for supporting the label.

Figure 7:
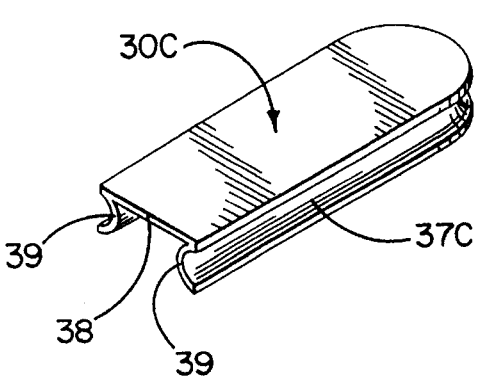

The label holder 30C of FIG. 7 is an insert similar to the insert 30B but, rather than being a solid plastic block, includes a flat plastic plate 38 with depending side wings 39. The outer periphery of the wings is formed with a retaining groove 37C for receiving the wire portions 26 and 27 of the nose 25.

Figure 8:
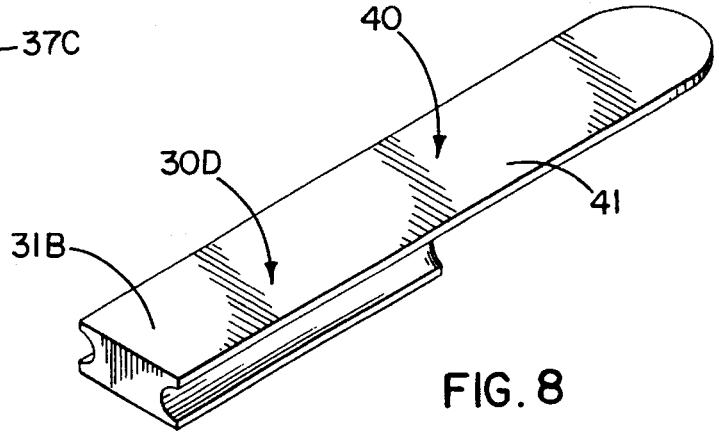
Figure 9:
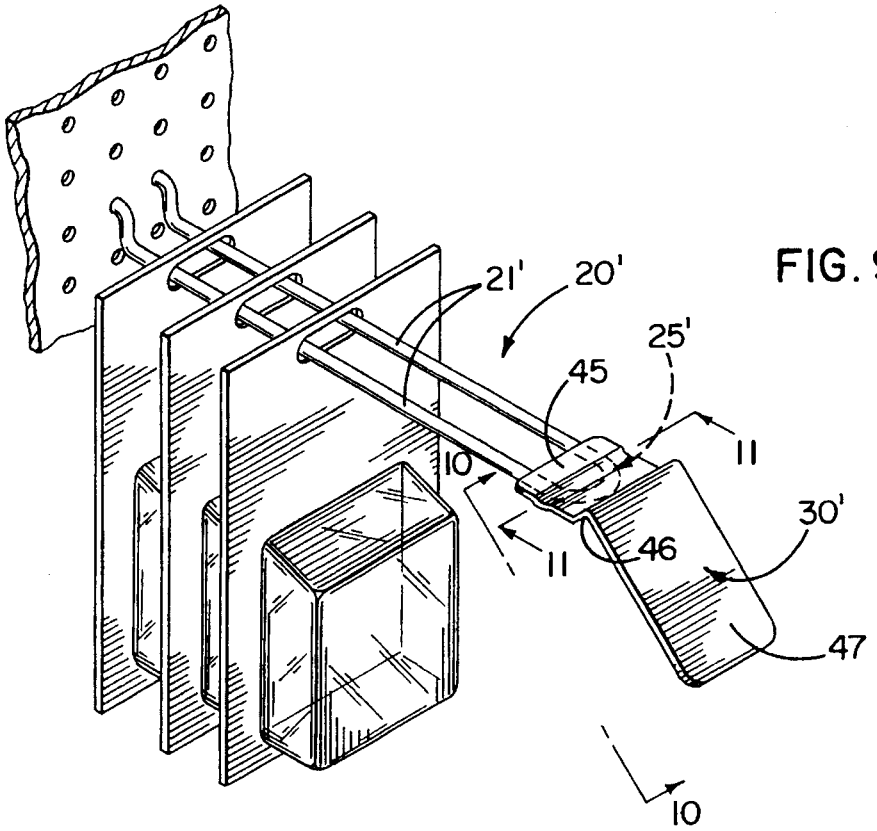
FIG. 9 is a view similar to FIG. 1 but shows a different type of loop hook with still another embodiment of a label holder.
Figure 10:
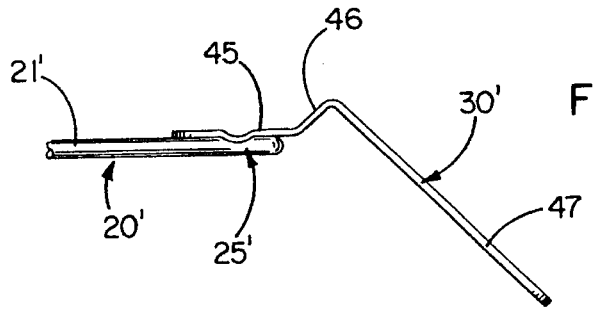
FIG. 10 is an enlarged fragmentary side elevational view as seen along the line 10—10 of FIG. 9.
Figure 11:
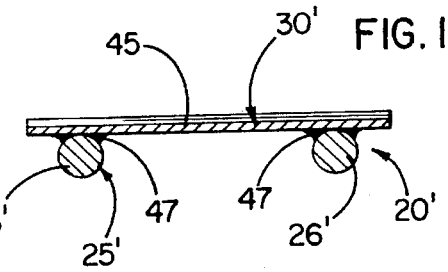
FIG. 11 enlarged fragmentary cross-section taken substantially along the line 11—11 of FIG. 9.

In FIG. 8, a block-like insert 30D is formed with an elongated tongue 40 whose upper surface 41 is located in the same plane as the upper surface 31B of the insert. The tongue projects downwardly and forwardly a substantial distance from the nose 25 of the hook 20 and provides additional surface area for a relatively long label. It will be appreciated that any of the holders 30, 30A, or 30C could be formed with a similar tongue.

FIGS. 9–12 illustrate a loop hook 20' which is of conventional construction in that its nose 25' is located in substantially the same plane as the arms 21'. One form of label holder 30' for use with such a hook comprises a single piece of sheet metal having a generally horizontal mounting portion 45, a short upwardly and forwardly inclined transition portion 46, and a downwardly and forwardly inclined label holding portion 47. The mounting portion 45 overlies the nose 25' and is welded at 47 (FIG. 11) to the upper sides of the straight wire portions 26' of the nose. As shown most clearly in FIG. 10, the label holding portion 47 is inclined downwardly and forwardly from the nose 25' at an obtuse angle and its upper surface defines a support surface for the label. The transition section 46 helps prevent packages 15 from being slid inadvertently off of the hook 20'.

Figure 12:
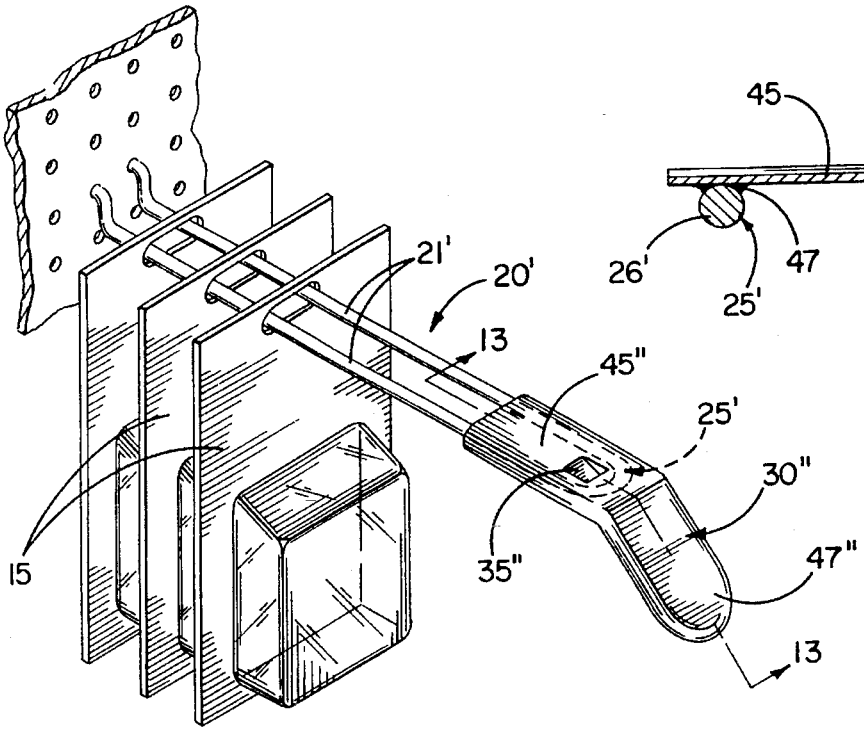
FIG. 12 is a view similar to FIG. 9 but shows the loop hook of FIG. 9 equipped with still another type of label holder.
Figure 13:
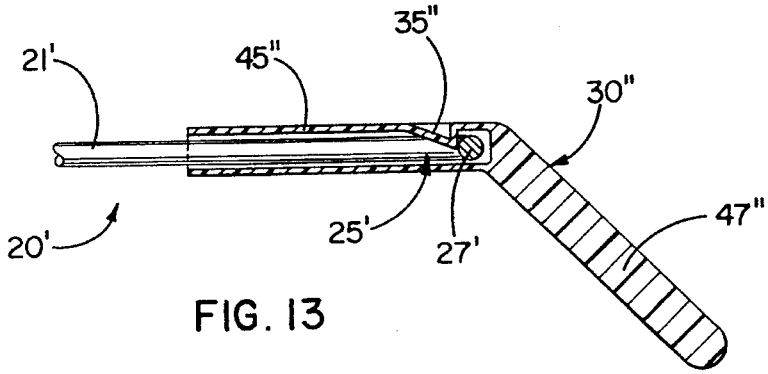
FIG. 13 is an enlarged fragmentary cross-section taken substantially along the line 13—13 of FIG. 12.

A plastic label holder 30" for use with the conventional hook 21' is shown in FIGS. 12 and 13. The holder 30" includes a mounting portion 45" in the form of a plastic sleeve similar to the sleeve 31 and telescoped over the nose 25', the sleeve 45" having a detent 35" releasably engageable with the rear side of the bridge portion 27' of the nose. Formed integrally with and inclined downwardly and forwardly from the mounting sleeve 45" is an elongated label holding portion 47" having an upwardly and forwardly facing upper surface for supporting a label. It should be appreciated that the label holders 30A, 30B, 30C and 30D may be similarly modified for use with the hook 20' by constructing such holders both with a mounting portion and with a label holding portion inclined downwardly and forwardly from the mounting portion.

From the foregoing, it will be apparent that the present invention brings to the art new and improved label holders particularly adapted for use with loop hooks and capable of being manufactured at relatively low cost. Being mounted by the nose of the hook, the holders do not obstruct overlying merchandise and enable easy removal of merchandise from the hook. The hook 20 with the angled nose 25 enables the construction of the label holder to be simplified even further and, in addition, such a hook guards against packages falling from the hook.

We claim:

1. The combination of, a hanger made of a single piece of wire and comprising two laterally spaced and generally horizontally extending wire arms each having forward and rear end portions, said hanger having a generally U-shaped wire nose integral with and extending between the forward end portions of said arms, and means formed separately of said hanger and having an upwardly and forwardly facing surface for holding a label, said means being attached to and spanning said nose and permanently extending downwardly and forwardly from said arms at an included angle of at least 110 degrees relative to said arms whereby articles on said hanger may be removed therefrom by sliding the articles forwardly along said arms and then downwardly and forwardly along said means, said nose is disposed in generally the same plane as said arms, said means having a generally horizontal mounting portion attached to said nose and having a label holding portion integral with and extending downwardly and forwardly relative to said mounting portion and located forwardly of said nose, said label holding surface being defined by a surface of said label holding portion, and said mounting portion and said label holding portion are made from a single piece of plastic, said mounting portion comprising a sleeve telescoped over said nose.

2. The combination defined in claim 1 further including a detent formed integrally with said mounting portion and engageable with said nose to releasably retain said mounting portion on said nose.

* * * * *